United States Patent [19]

Itsubo et al.

[11] Patent Number: 4,588,100

[45] Date of Patent: May 13, 1986

[54] PILFER-PROOF PLASTIC CLOSURE FOR CONTAINERS

[75] Inventors: Junichi Itsubo; Takashi Yazaki, both of Hiratsuka; Fumio Mori, Yokohama, all of Japan

[73] Assignee: Japan Crown Cork Co., Ltd., Tokyo, Japan

[21] Appl. No.: 688,391

[22] Filed: Jan. 2, 1985

Related U.S. Application Data

[63] Continuation-in-part of Ser. No. 581,845, Feb. 21, 1984, Pat. No. 4,520,939.

[30] Foreign Application Priority Data

Oct. 26, 1984 [JP] Japan ..... 59-224126

[51] Int. Cl.[4] ..... B65D 41/34

[52] U.S. Cl. ..... 215/252

[58] Field of Search ..... 215/252

[56] References Cited

U.S. PATENT DOCUMENTS 4,418,828 12/1983 Wilde et al. ..... 215/252

4,488,655 12/1984 Itsubo et al. ..... 215/252

*Primary Examiner*—Donald F. Norton

*Attorney, Agent, or Firm*—Beveridge, DeGrandi and Weilacher

[57] ABSTRACT

A pilfer-proof plastic closure comprising a top panel wall and a cylindrical skirt wall extending downwardly from the peripheral edge of the top panel wall. The skirt wall has formed therein a circumferentially extending breakable line dividing the skirt wall into a main portion above the breakable line and a pilfer-proof bottom portion below it. The main portion has formed on its inner surface an internal thread and the pilfer-proof bottom portion has formed on its inner surface a plurality of radially inwardly projecting engaging flaps at circumferentially spaced positions. Each of said engaging flaps has a first portion extending from the inner surface of the pilfer-proof bottom portion and a second portion extending further from the forward end of the first portion inclinedly to the first portion in the closing direction of the closure for mounting the closure on the mouth-neck portion.

15 Claims, 4 Drawing Figures

PILFER-PROOF PLASTIC CLOSURE FOR CONTAINERS

CROSS-REFERENCE TO RELATED APPLICATION

This application is a continuation-in-part application of our pending application Ser. No. 581,845 filed 2-21-84 now U.S. Pat. No. 4,520,939.

FIELD OF THE INVENTION

This invention relates to a pilfer-proof plastic closure for containers, and more specifically, to a pilfer-proof plastic closure for application to a container equipped with a mouth-neck portion having an external thread on its peripheral surface and a holding jaw portion beneath the external thread.

DESCRIPTION OF THE PRIOR ART

Pilfer-proof metallic closures for containers holding various drinks have recently been superseded by pilfer-proof plastic closures. A typical example of such plastic container closures is disclosed in Japanese Laid-Open Patent Publication No. 74445/1981 and U.S. Pat. No. 4,418,828.

The closure disclosed in these patent documents has a top panel wall and a cylindrical skirt wall extending downwardly from the peripheral edge of the top panel wall. A circumferentially extending breakable line is formed in the skirt wall to divide it into a main portion above the breakable line and a pilfer-proof bottom portion below it. An internal thread is formed on the inner surface of the main portion, and a plurality of radially inwardly projecting engaging flaps are formed on the inner surface of the pilfer-proof bottom portion at circumferentially spaced positions.

The plastic closure of the above structure is applied to a container equipped with a mouth-neck portion having an external thread formed on its peripheral surface and a holding jaw portion located beneath the external thread. To close the mouth-neck portion of the container with the closure, the closure is put over the mouth-neck portion and turned in a closing direction to fit the external thread of the mouth-neck portion in the internal thread of the closure. As a result, the closure turns in the closing direction with respect to the mouth-neck portion and at the same time, moves axially downwardly. At this time, the holding jaw portion formed on the outer surface of the mouth-neck portion interferes with the engaging flaps formed on the inner surface of the pilfer-proof bottom portion to elastically bend them radially outwardly. When the engaging flaps completely go past the holding jaw portion, they elastically return radially inwardly and are held to the undersurface of the holding jaw portion. To open the mouth-neck portion of the container, the closure is turned in an opening direction which is reverse to the closing direction. As a result, the internal thread of the closure is moved along the external thread of the mouth-neck portion, and therefore, the closure turns in the opening direction and simultaneously moves axially upwardly. The pilfer-proof bottom portion of the closure, however, cannot move axially upwardly because the engaging flaps formed on its inner surface engage the undersurface of the holding jaw portion of the mouth-neck portion. This results in a considerable stress on the breakable line formed in the skirt wall of the closure. Consequently, the breakable line is completely broken to separate the skirt wall into the main portion and the pilfer-proof bottom portion. Or the breakable line is broken while leaving a part of it, and at the same time, an axially extending breakable line provided in the pilfer-proof bottom portion is broken to open the endless annular pilfer-proof bottom portion into a tape form. Thereafter, the closure is removed from the mouth-neck portion either entirely or while leaving the separated pilfer-proof bottom portion. The mouth-neck portion of the container is thus opened.

It is important that container closure of the above structure and function should meet the following two requirements. Firstly, in closing the mouth-neck portion of the container with the closure, the engaging flaps should be easily bendable elastically in the radially outward direction during their passage over the holding jaw portion, so as to mount the closure on the mouth-neck portion with a relatively low rotating torque and to accurately prevent generation of an excessive stress on the breakable line which will result in its breakage. Secondly, in opening the mouth-neck portion of the container, the engaging flaps should fully accurately engage the holding jaw portion so as to accurately prevent the closure from slipping out of the mouth-neck portion without the breakage of the breakable line as a result of the engaging flaps going past the holding jaw portion while being bent radially outwardly. It will be appreciated that if this slipping occurs, the pilfer-proof characteristics of the closure will be impaired. In order for the closure to meet these two requirements, it is necessary to reduce sufficiently the downwardly rotating torque which must be exerted on the closure when the engaging flaps are passed over the holding jaw portion axially downwardly from above, to increase sufficiently the upwardly rotating torque which must be exerted on the closure when the engaging flaps are passed over the holding jaw portion axially upwardly from below, and to adjust the breaking rotating torque which must be exerted on the closure for breaking the breakable line as desired to a value between the required downwardly rotating torque and the required upwardly rotating torque.

In conventional container closures, however, no sufficient difference can be set up between the required downwardly rotating torque and the required upwardly rotating torque, and frequently, owing to errors in production, the containers do not meet the aforesaid first or second requirement.

SUMMARY OF THE INVENTION

It is a primary object of this invention to provide a pilfer-proof plastic container closure which has been improved such that a sufficient difference is set up between the required downwardly rotating torque and the required upwardly rotating torque by sufficiently decreasing the former and sufficiently increasing the latter and consequently the closure accurately meets the aforesaid first and second requirements.

In a conventional plastic closure, each of the engaging flaps in its entirety is tilted in a direction opposite to the rotating direction of the clusure during mounting on the mouth-neck portion of a container and extends continuously in a straight line from the inner surface of the pilfer-proof bottom portion. Extensive investigations and experiments of the present inventors have now led to the discovery that if each of the engaging flaps is bent to provide a first portion extending from the inner surface of the pilfer-proof bottom portion and a second portion further extending from the forward end of the first portion while being inclined to the first portion in the closing direction of the container closure for mounting the closure on the mouth-neck portion, the aforesaid required upwardly rotating torque can be increased considerably while suppressing the increase of the required downwardly rotating torque, and consequently, the aforesaid object can be achieved.

Thus, according to this invention, there is provided a pilfer-proof plastic closure for a container equipped with a mouth-neck portion having an external thread formed on its peripheral surface and a holding jaw portion located below the external thread, said closure comprising a top panel wall and a cylindrical skirt wall extending downwardly from the peripheral edge of the top panel wall, said skirt wall having formed therein a circumferentially extending breakable line dividing the skirt wall into a main portion above the breakable line and a pilfer-proof bottom portion below it, said main portion having formed on its inner surface an internal thread to be engaged with the external thread on the mouth-neck portion of the container and said pilfer-proof bottom portion having formed on its inner surface a plurality of radially inwardly projecting engaging flaps at circumferentially spaced positions; each of said engaging flaps having a first portion extending from the inner surface of the pilfer-proof bottom portion and a second portion further extending from the forward end of the first portion inclinedly to the first portion in the closing direction of the closure for mounting the closure on the mouth-neck portion.

DETAILED DESCRIPTION OF PREFERRED EMBODIMENTS

The improved plastic container of the invention will be described in detail hereinbelow with reference to the accompanying drawings showing its preferred embodiments.

Figure 1:
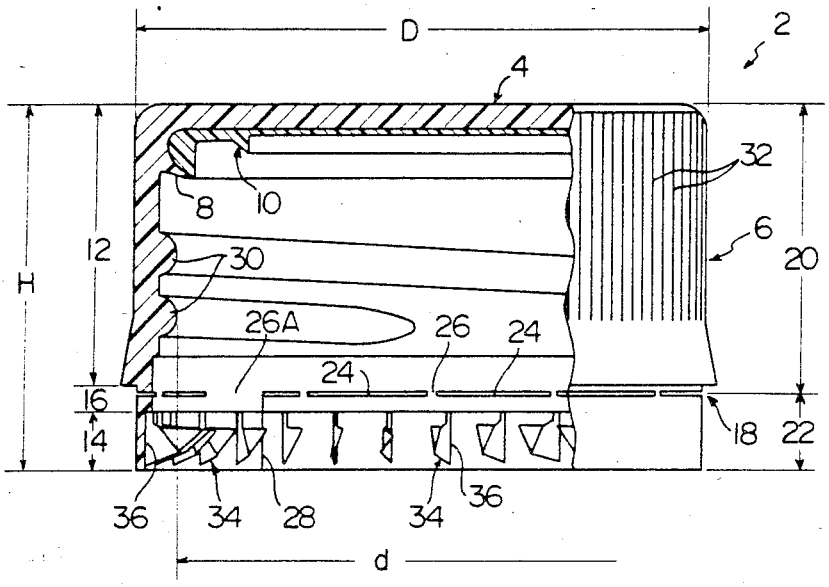
FIG. 1 is a side elevation partly in section of one embodiment of the container closure improved in accordance with this invention.

With reference to FIG. 1, the container closure shown generally at 2 has a one-piece main body comprised of a circular top panel wall 4 and a cylindrical skirt wall 6 extending downwardly from the peripheral edge of the top panel wall 4. The main body can be formed by compression molding or injection molding of a suitable plastic material such as polyolefinic resins.

In the illustrated embodiment, an annular protrusion 8 is formed in the upper end portion of the inner surface of the skirt wall 6 so that it projects radially inwardly from the upper end portion. A circular sealing liner 10 formed separately from the main body of the closure is disposed in a region defined by the annular protrusion 8 and the inner surface of the top panel wall 4. The sealing liner 10 can be formed at a required position, for example after fabrication of the main body, by a well known molding method from a suitable plastic material. If desired, instead of forming the sealing liner separately from the main body, a sealing projection of a suitable form may be integrally formed on the inner surface of the top panel wall or the upper end portion of the skirt wall 6.

The skirt wall 6 has an upper portion 12 of a relatively large thickness, a lower portion 14 of a relatively small thickness and an intermediate portion 16 of an intermediate thickness located between them. A circumferentially extending breakable line 18 is formed in the intermediate portion 16. The skirt wall 6 is thus divided into a main portion 20 above the breakable line 18 and a pilfer-proof bottom portion 22 below it. The breakable line 18 may, for example, be a so-called score formed by reducing the thickness of the material of which the skirt wall is made. In the illustrated embodiment, the breakable line 18 is comprised of a plurality of circumferentially extending slits (cut channels) 24 spaced from each other circumferentially and a plurality of bridging portions 26 left among the slits 24. The pilfer-proof bottom portion 22 is connected to the main portion 20 by the plurality of bridging portions 26. In the illustrated embodiment, a specified bridging portion 26A among the plurality of bridging portions 26 has a larger circumferential width and therefore a higher strength than the other bridging portions 26. At a position adjacent to the one side edge in the circumferential direction of the specified bridging portion 26A, an axially extending breakable line 28 is formed in the pilfer-proof bottom portion 22. The breakable line 28 may be a score or a perforation.

An internal thread 30 is formed on the inner surface of the main portion 20 of the skirt wall 6, more specifically on the inner surface of the top portion 12 of the relatively large thickness. Conveniently, raisings and depressions or knurls 32 are formed on the outside surface of the main portion 20, more specifically on the inner surface of the lower portion 14 of a relatively small thickness to prevent slippage of fingers during turning of the closure with the fingers. Furthermore, a plurality of (30 in the illustrated embodiment) circumferentially spaced engaging flaps 34 are formed on the inner surface of the pilfer-proof bottom portion 22. Each of these engaging flaps 34 extends radially from its base edge 36 connected to the inner surface of the pilfer-proof bottom portion 22.

The aforesaid structure of the closure 2 shown in the drawings does not constitute a novel feature of the closure 2 improved in accordance with this invention, but is merely one example of container closures to which the invention is applicable.

Figure 2:
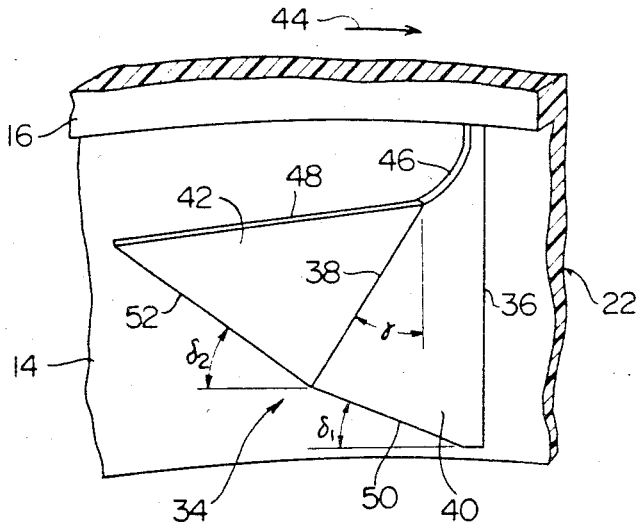
FIG. 2 is a partial perspective view showing an engaging flap in the container closure of FIG. 1.
Figure 3:
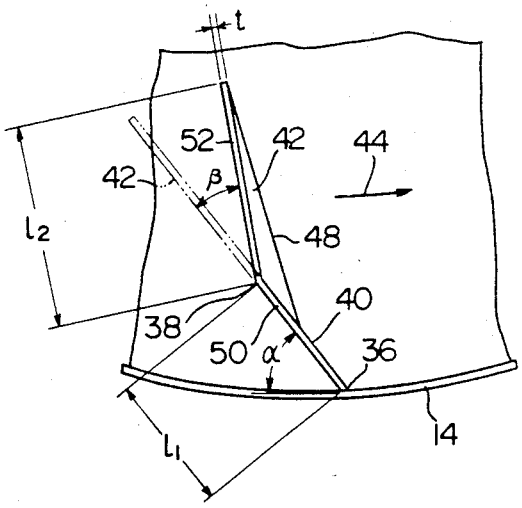
FIG. 3 is a partial bottom view showing the engaging flap in the container closure of FIG. 1.

According to this invention, the following improvement is made in the engaging flaps 34. With reference to FIGS. 2 and 3, each of the engaging flaps 34 is bent along a bending line 38 and defined by a first portion 40 extending from the base edge 36 to the bending line 38 and a second portion 42 extending from the bending line 38 to its free end. The base edge 36 extends substantially parallel, and therefore substantially vertically, to the central axis of the closure 2. If desired, however, the base edge 36 may be inclined in a suitable direction with respect to the central axis of the closure 2; namely it may be inclined downwardly at a suitable angle to the closing direction of the closure 2 for mounting the closure 2 on the mouth-neck portion of the container (the clockwise direction as viewed from above in FIG. 1, the direction shown by arrow 44 in FIGS. 2 and 3) or in an opposite direction. Preferably, the first portion 40 is inclined in a direction opposite to the aforesaid closing direction and extends radially inwardly from the base edge 36. The angle $\alpha$ of inclination of the first portion 40 to the inner surface of the pilfer-proof bottom portion 22 is preferably $5° \leqq \alpha \leqq 85°$, more preferably $20° \leqq \alpha \leqq 80°$, especially preferably $30° \leqq \alpha \leqq 70°$. It is important that the second portion 42 extending radially inwardly from the bending line 38 should extend inclinedly with respect to the first portion 40 in the aforesaid closing direction. The angle $\beta$ of inclination of the second portion 42 to the first portion 40 is preferably $0° < \beta \leqq 90°$, more preferably $0° < \beta \leqq 70°$, especially preferably $5° \leqq \beta \leqq 45°$. The bending line 38 may extend substantially parallel, and therefore substantially vertically, to the central axis of the closure 2, or may be inclined downwardly approaching the inner surface of the pilfer-proof bottom portion 22. Preferably, it is inclined downwardly in a direction away from the inner surface of the pilfer-proof bottom portion 22. The angle $\gamma$ of inclination of the bending line 38 to the downward direction away from the inner surface of the pilfer-proof bottom portion 22 is preferably $5° \leqq \gamma \leqq 80°$, more preferably $10° \leqq \gamma \leqq 60°$, especially preferably $20° \leqq \gamma \leqq 50°$.

As shown in FIGS. 1 and 2, the upper edge 46 of the first portion 40 conveniently extends downwardly inclinedly in a radially inward direction forming a gentle curve, and the upper edge 48 of the second portion 42 extends nearly horizontally. On the other hand, it is convenient that the lower edge 50 of the first portion 40 and the lower edge 52 of the second portion 42 extend upwardly inclinedly in a radially inward direction. Generally, the angle $\delta_2$ of inclination of the lower edge 52 of the second portion 42 is slightly larger than the angle $\delta_1$ of inclination of the lower edge 50 of the first portion 40. Conveniently, the angle $\delta_1$ of inclination is $10° \leqq \delta_1 \leqq 30°$, and the inclination angle $\delta_2$ is $20° \leqq \delta_2 \leqq 50°$.

Figure 4:
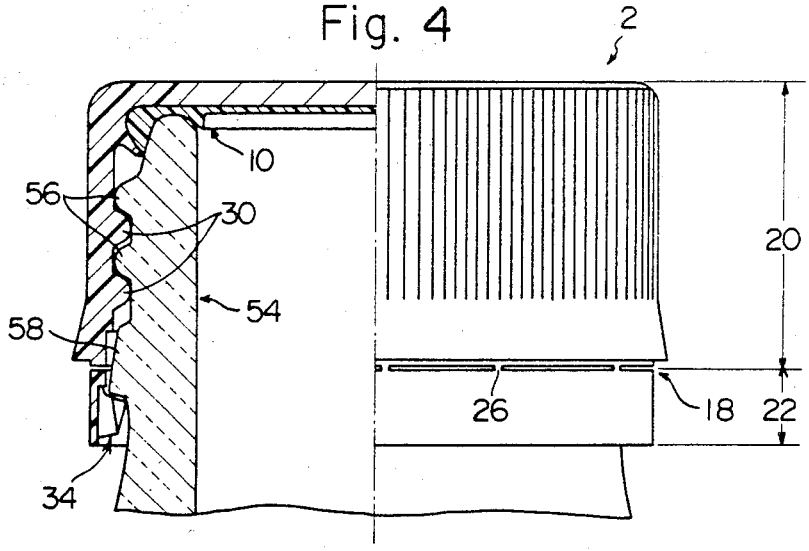
FIG. 4 is a side elevation partly in section of the state in which the container closure of FIG. 1 has been mounted on the mouth-neck portion of a container to close it.

The plastic closure 2 described above is applied to a container having a mouth-neck portion 54 of the structure depicted in FIG. 4. The mouth-neck portion 54 is known per se, and has a cylindrical peripheral surface. The peripheral surface has formed therein an external thread 56 and a holding jaw portion 58 located below the external thread 56.

In closing the mouth-neck portion 54 with the closure 2, the closure 2 is put over the mouth-neck portion and turned in a closing direction, that is, in the clockwise direction as viewed from above in FIG. 4. As a result, the internal thread 30 formed in the closure 2 is engaged with the external thread 56 formed in the mouth-neck portion 54, and the closure 2 is moved axially downwardly. Each of the engaging flaps 34 formed in the closure 2 thus goes past the external thread 56 formed on the mouth-neck portion 54 and further passes over the holding jaw portion 58. During passage over the holding jaw portion 58, each of the engaging flaps 34 undergoes interference by the holding jaw portion 58 and is elastically bent radially outwardly. When the internal thread 30 of the closure 2 is fully engaged with the external thread 56, each of the engaging flaps 34 completely goes past the holding jaw portion 58 and is released from interference by the holding jaw portion 58. As a result, the engaging flaps 34 elastically returned to their original state.

It will be clearly understood from Example and Comparative Example given hereinbelow that the required downwardly rotating torque which must be exerted on the closure 2 of this invention during passage of the elastically bent engaging flaps 34 over the holding jaw portion 58 is nearly equal to that in a conventional container closure in which the second portion 42 of each engaging flap 34 is not bent with the first portion 40 but extends in a straight light with the first portion 40 as shown by a two-dot chain line in FIG. 3, and is therefore sufficiently low. Accordingly, during mounting of the closure 2 on the mouth-neck portion 54, the generation of an excessive stress on the breakable lines 18 and 28 can be surely prevented, and therefore, the breakable lines can be accurately prevented from breaking at this time.

When the engaging flaps 34 fully return to their original state, they engage the undersurface of the holding jaw portion 58 as clearly shown in FIG. 4. When the internal thread 30 of the closure 2 is in full engagement with the external thread 56 on the mouth-neck portion, 54 the sealing liner 10 is in intimate contact with the end surface portion of the mouth-neck portion 54, and thus seals up the mouth-neck portion 54.

To open the mouth-neck portion 54 by removing the closure 2 from it, the closure 2 is turned in a direction opposite to the rotating direction during mounting of the closure 2, that is, counterclockwise as viewed from above in FIG. 4. As a result, the internal thread 30 formed in the closure 2 is moved along the external thread 56 on the mouth-neck portion 54, and the closure 2 tends to move upwardly. However, the upward movement of the pilfer-proof bottom portion 22 is hampered since the engaging flaps 34 formed on the inner surface of the pilfer-proof bottom portion 22 engage the undersurface of the holding jaw portion 58 of the mouth-neck portion 54. Consequently, a considerable stress is exerted on the breakable line 18 formed in the closure 2, and the bridging portions 26 of the breakable line 18 are broken excepting the specified bridging portion 26A having a large circumferential width and an increased strength. A considerable stress is also exerted on the breakable line 28 formed in the pilfer-proof bottom portion 22 to break the breakable line 28, with the result that the endless annular pilfer-proof bottom portion 22 is opened into a tape form. As a result, the engagement of the engaging flaps 34 with the undersurface of the holding jaw portion 58 is released. Thereafter, the entire closure 2 including the pilfer-proof bottom portion 22 connected to the main portion 20 through the specified bridging portion 20A which remains unbroken is moved axially upwardly as it it turned. The entire closure 2 is thus removed from the mouth-neck portion 54. If the specified bridging portion 26A in the breakable line 18 has substantially the same strength as the other bridging portions and no breakable line 28 is formed in the pilfer-proof bottom portion 22, the breakable line 18 is completely broken and the pilfer-proof bottom portion 22 is completely separated from the main portion 20. Accordingly, while the pilfer-proof bottom portion 22 is left at the mouth-neck portion 54, all the other portions of the closure 2 are removed from the mouth-neck portion 54.

As will be clearly understood from the description of the following Example and Comparative Example, the engaging flaps 34 engage the undersurface of the holding jaw portion 58 more strongly in the closure 2 improved in accordance with this invention than in the conventional closure in which the second portion 42 of each engaging flap 34 is not bent with respect to the first portion 40 but extends in a straight line with the first portion 40 as shown by the two-dot chain line in FIG. 3. In other words, the required upwardly rotating torque which must be exerted on the closure 2 of this invention when the engaging flaps 34 are passed in the elastically bent state over the holding jaw portion 58 in the upward direction is made considerably higher than that on the conventional closure. Hence, the closure is surely prevented from being removed from the mouth-neck portion 54 without the desired breakage of the breakable lines 18 and 28, and the pilfer-proof characteristics of the closure 2 can be retained.

If desired, it is possible to provide a holding protrusion on the outside surface of the pilfer-proof bottom portion 22, preferably adjacent to the right side of the breakable line 28, so that in opening the mouth-neck portion 54 by removing the closure 2 from it, the holding protrusion is pulled to break the breakable line 28 and simultaneously the breakable line 18 in its entirety, and thereafter, the closure 2 is turned counterclockwise as viewed from above in FIG. 4.

EXAMPLE

Ten closure bodies having substantially the same form as the main body of the closure 2 shown in FIGS. 1 to 3 except that the breakable line 18 and the breakable line 28 were not formed were molded from polypropylene having a melt index of 2.0 and a density of 0.90. Each closure body has an internal thread inside diameter d of 25.4 mm, an upper portion outside diameter D of 30.0 mm and a total height H of 19.0 mm. Each of the engaging flaps 34 formed on the inner surface of the pilfer-proof bottom portion 22 had the following specification.

Thickness t: 0.35 mm
Length 11 of the lower edge 50 of the first portion 40: 1.9 mm
Length 12 of the lower edge 52 of the second portion 42: 2.0 mm
Inclination angle $\alpha$: 50°
Inclination angle $\beta$: 10°
Inclination angle $\gamma$: 30°
Inclination angle $\delta_1$: 20°
Inclination angle $\delta_2$: 45°

The upper edge 46 of the first portion 40 was of an arcuate shape having a radius of 0.5 mm, and the upper edge 48 of the second portion 42 was substantially horizontal.

Each of the closure bodies was mounted on the mouth-neck portion 54 of a glass container having the form shown in FIG. 4 and a nominal diameter of 28 mm, and the required downwardly rotating torque was measured.

Thereafter, the closure body was forcedly removed from the mouth-neck portion 54, and the required upwardly rotating torque was measured. The results are shown in Table 1 below.

COMPARATIVE EXAMPLE

For comparison, ten closure bodies same as in Example were molded except that each of the engaging flaps 34 formed on the inner surface of the pilfer-proof bottom portion 22 had the form shown by the two-dot chain line in FIG. 3 (namely, the second portion 42 was not bent with respect to the first portion 40 but extended in a straight line with the first portion 40).

In the same way as in Example, the required downwardly rotating torque and the required upwardly rotating torque were measured. The results are shown in Table 1.

TABLE 1

| | Required downwardly rotating torque (kg-cm) | | | Required upwardly rotating torque (kg-cm) | | |
|---|---|---|---|---|---|---|
| | Average | Maximum | Minimum | Average | Maximum | Minimum |
| Example | 1.5 | 2.0 | 1.0 | 9.0 | 10.0 | 8.0 |
| Comparative Example | 1.4 | 2.0 | 1.0 | 4.0 | 4.5 | 3.5 |

What is claimed is:

1. A pilfer-proof plastic closure for a container equipped with a mouth-neck portion having an external thread formed on its peripheral surface and a holding jaw portion located below the external thread, said closure comprising a top panel wall and a cylindrical skirt wall extending downwardly from the peripheral edge of the top panel wall, said skirt wall having formed therein a circumferentially extending breakable line dividing the skirt wall ihto a main portion above the breakable line and a pilfer-proof bottom portion below it, said main portion having formed on its inner surface an internal thread to be engaged with the external thread on the mouth-neck portion of the container and said pilfer-proof bottom portion having formed on its inner surface a plurality of radially inwardly projecting engaging flaps at circumferentially spaced positions; each of said engaging flaps having a first portion extending from the inner surface of the pilfer-proof bottom portion and a second portion extending further from the forward end of the first portion inclinedly to the first portion in the closing direction of the closure for mounting the closure on the mouth-neck portion.

2. The closure of claim 1 wherein the first portion extends from the inner surface of the pilfer-proof bottom portion inclinedly in a direction opposite to said closing direction.

3. The closure of claim 2 wherein the angle $\alpha$ of inclination of the first portion to the inner surface of the pilfer-proof bottom portion is $5° \leqq \alpha \leqq 85°$.

4. The closure of claim 3 wherein the inclination angle $\alpha$ is $20° \leqq \alpha \leqq 80°$.

5. The closure of claim 4 wherein the inclination angle $\alpha$ is $30° \leqq \alpha \leqq 70°$.

6. The closure of claim 1 wherein the angle $\beta$ of inclination of the second portion to the first portion is $0° \leqq \beta \leqq 90°$.

7. The closure of claim 6 wherein the inclination angle $\beta$ is $0° \leqq \beta \leqq 70°$.

8. The closure of claim 7 wherein the inclination angle $\beta$ is $5° \leqq \beta \leqq 45°$.

9. The closure of claim 1 wherein a bending line between the first portion and the second portion extends downwardly while being inclined in a direction away from the inner surface of the pilfer-proof bottom portion.

10. The closure of claim 9 wherein the angle $\gamma$ of inclination of the bending line to the direction away from the inner surface of the pilfer-proof bottom portion is $5° \leqq \gamma \leqq 80°$.

11. The closure of claim 10 wherein the inclination angle $\gamma$ is $10° \leqq \gamma \leqq 60°$.

12. The closure of claim 11 wherein the inclination angle $\gamma$ is $20° \leqq \gamma \leqq 50°$.

13. The closure of claim 1 wherein the upper edge of the first portion extends radially inwardly while being inclined downwardly, and the upper edge of the second portion extends nearly horizontally.

14. The closure of claim 13 wherein the upper edge of the first portion forms a gentle curve.

15. The closure of claim 1 wherein the lower edge of the first portion and the lower edge of the second portion extend radially inwardly while being inclined upwardly.

* * * * *